US006098238A

United States Patent [19]

Stern

[11] Patent Number: 6,098,238

[45] Date of Patent: Aug. 8, 2000

[54] FLOOR TREATING DEVICE WITH SHEEPSKIN COVER

[75] Inventor: Jeffrey A. Stern, Bayside, Wis.

[73] Assignee: Stern Tanning Co., Inc., Sheboygan Falls, Wis.

[21] Appl. No.: 09/222,212

[22] Filed: Dec. 29, 1998

Related U.S. Application Data

[63] Continuation-in-part of application No. 08/777,530, Dec. 30, 1996, Pat. No. 5,852,842.

[51] Int. Cl.[7] ..... A47L 13/10; A47L 13/38

[52] U.S. Cl. ..... 15/228; 15/235; 15/247

[58] Field of Search ..... 15/228, 235, 247

[56] References Cited

U.S. PATENT DOCUMENTS

| | | |
|---|---|---|
| 528,754 | 11/1894 | Ziegler et al. . |
| 2,858,559 | 11/1958 | Carlson, Sr. . |
| 3,699,603 | 10/1972 | Popeil . |
| 4,858,267 | 8/1989 | Unger . |
| 5,042,105 | 8/1991 | Buck et al. . |
| 5,177,831 | 1/1993 | Wirth . |
| 5,331,711 | 7/1994 | Kelly . |
| 5,852,842 | 12/1998 | Stern . |

FOREIGN PATENT DOCUMENTS

| | | |
|---|---|---|
| 341466 | 1/1931 | United Kingdom . |

OTHER PUBLICATIONS

Advertisement of Jones Companies, Ltd. of Humboldt, TN for Jones Dust–Mop.

Advertisement of Woodbury Box Company, Inc. of Woodbury, GA for Clip–On value hardware.

*Primary Examiner*—Randall E. Chin

*Attorney, Agent, or Firm*—Andrus, Sceales, Starke & Sawall

[57] ABSTRACT

The floor treating device includes a tubular sheepskin sleeve telescoped over a single-piece rectangular wooden block having a bottom side and top side. A handle is threaded into an opening on the top side and passed through an opening in the sleeve. The sleeve is formed from a sheepskin blank or a fur including a base fabric and a dense woven pile of soft fibers to define the outer nap. The inner opening of the sleeve is slightly greater than the block. A top thin member a bottom member with the dense woven pile is superimposed and have the longitudinal edges which are sewn together to form the sleeve. A pair of scrap sheepskin blanks cover on the bottom of the head having the opposed longitudinal edges sewn together to form the sleeve. The sewn seam extends outwardly or inwardly into engagement with the head. One end of the sleeve edges may have the end sewn together to again form a closed end. The sleeve is also formed of a tanned sheepskin with the nap exposed for engagement with the floor, and the skin engaging the head, and has a reasonably firm fit to the head. The handle opening and fit maintain stability and location of the sleeve on the head.

8 Claims, 3 Drawing Sheets

FIG. 1
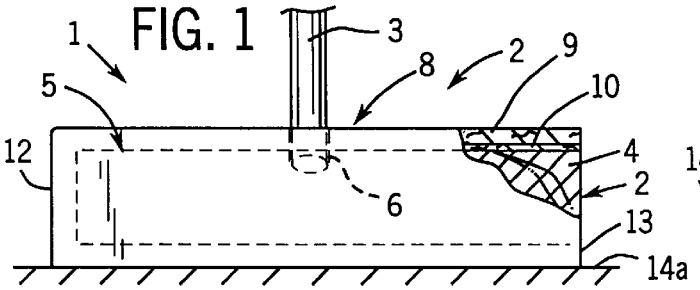
FIG. 3
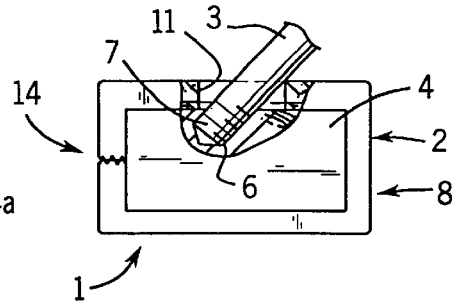
FIG. 2
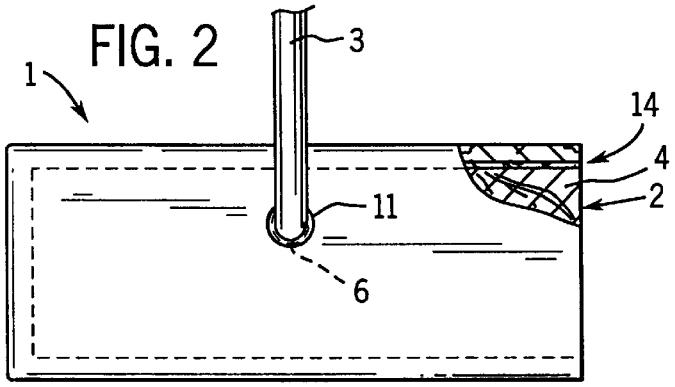
FIG. 4
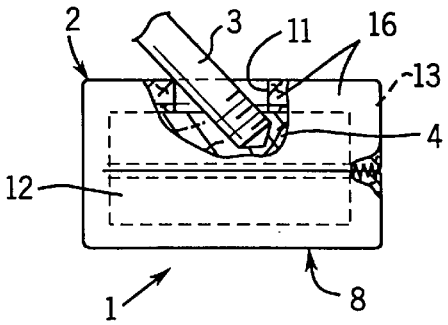
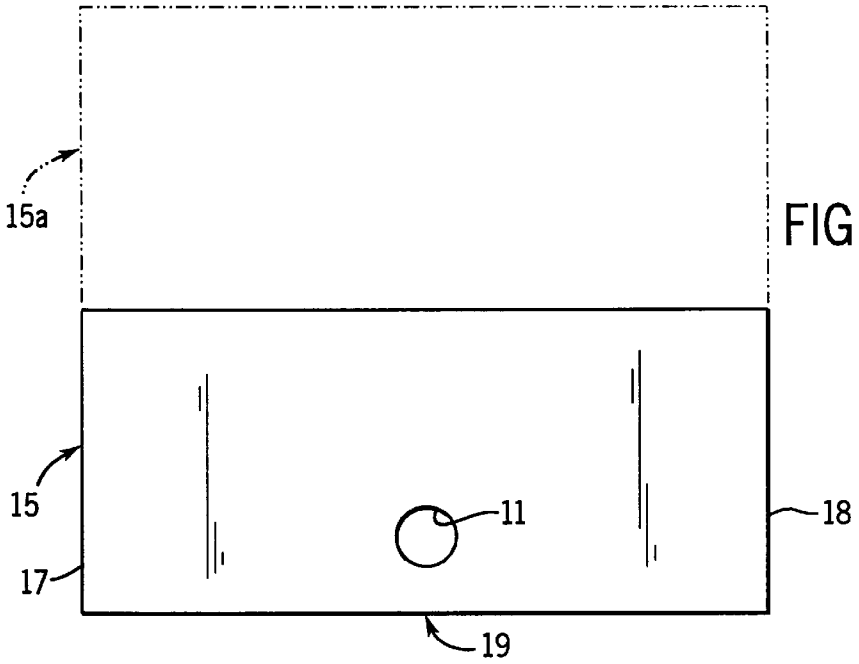
FIG. 5
FIG. 6
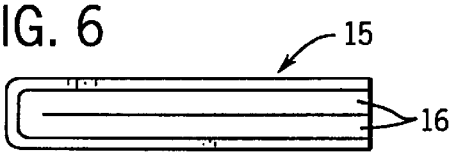
FIG. 7
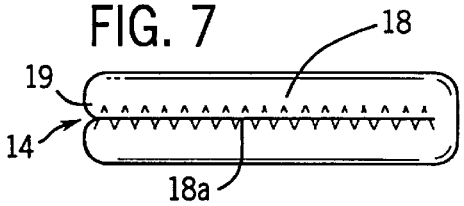

FLOOR TREATING DEVICE WITH SHEEPSKIN COVER

CROSS-REFERENCE TO RELATED APPLICATIONS

This application is a continuation-in-part of the application entitled "Floor Treating Device With Sheepskin Cover", filed on Dec. 30, 1996 with Ser. No. 08/777,530, now U.S. Pat. No. 5,852,842.

STATEMENT REGARDING FEDERALLY SPONSORED RESEARCH OR DEVELOPMENT

Not applicable.

BACKGROUND OF THE INVENTION

This invention relates to a floor treating device, and particularly for cleaning, polishing and/or waxing of a floor.

Floor cleaning and maintaining not only requires periodic washing, but often require waxing and polishing. Various hand operated devices are commercially available. Thus, rag and sponge mops are widely used for cleaning. Generally, a sponge pad is releasably secured to a pad holder and a means is provided for manual collapsing of the sponge pad for removing of the dirty water and the like. Generally, the pads are secured to a mounting base having threaded attachment with such as a clip mechanism or other separate holder on the outer end of the mop handle. Rotating devices such as disclosed in U.S. Pat. No. 3,699,603 are also suggested in the prior art. As shown in the above patent, a sponge covered roller is secured with the handle attached to the axial end of the sponge roller to provide a rolling action. An outer fabric cover or shell is provided over the sponge to protect the sponge structure.

For polishing a floor, various automated devices are used, including rotating pad devices. Manual devices are also available. The manual devices are generally constructed in accordance with the sponge mop devices.

A particular commercially available unit for manual treatment includes a sheepskin covered wood block unit having a handle releasably secured thereto. A tanned sheepskin blank or pad is folded about a wood block with the opposite ends interposed between the wood block and an outer clamp block. Clamping screws clamp the blocks to each other and releasably secure the pad in place. The structure including the tanned sheepskin blanks is relatively costly compared to cloth pads. The product can use relatively inexpensive scrap sheepskin material to reduce the cost. Generally, the quality characteristic has provided the necessary justification for the cost of the sheepskin floor treating devices. The method of assembly and replacement, off the sheepskin cover is also inconvenient in wrapping of the opposite end portion about the head block and attachment of the clamp block for holding of the sheepskin pad place.

Because of the advantages and demand for the sheepskin covered floor treating device, there is a need for a more convenient system of assembly and replacement while maintaining the quality characteristics of the existing devices, and preferably at a similar or reduced cost.

BRIEF SUMMARY OF THE INVENTION

The present invention is particularly directed to a cost effective replacement unit for a floor treating device with a sheepskin covered head unit. Generally, in accordance with the teaching of the present invention, a head unit includes a tubular sheepskin sleeve telescoped over a single head member to which a handle is secured. The head member has a top side and a bottom side and includes a handle attachment or coupling unit and a releasably interconnected handle. The tubular sheepskin sleeve includes an opening aligned with the handle attachment unit and the handle which contributes to holding the sheepskin sleeve in place upon the head.

In a preferred construction of the present invention, tanned sheepskin blanks are formed, preferably from scrap sheepskin. The head unit is a block-like member and preferably a simple rectangular block of wood. A handle coupling is secured to the top side of the block. At least one blank has a width greater than the width of the head. The blanks are secured to each other along the opposite edges to form the sleeve with an end opening. A handle opening is formed in the one blank and the tubular sleeve is assembled to the head with the seams spaced from the bottom finishing surface and the handle opening on the top side. In a preferred fabrication, the blanks are assembled with sheepskin nap in face-to-face relation and interconnected as by sewing along the longitudinal edges. The sewn tube is turned inside out to expose the nap, with the interconnecting seams on the inner face and with the desired tubular configuration for telescoping over the head, with seams facing inwardly along the opposite sides of the head.

In the preferred construction of this embodiment, one end would also be sewn together during the initial sewing of the single or two sheepskin blanks such that the sleeve is closed at one end.

The sleeve can, of course, be formed of a single sheepskin blank having a width sufficient to completely encircle and form a tubular sleeve, with a single longitudinal connecting edge. A preferred construction would again include closing one end of the sleeve. In fabrication, the blank would be folded on the inner nap and exposing the sheepskin base. The edges of the blank are sewn or otherwise secured along the longitudinal edges and one end edge, and then inverted to expose the nap to form the sleeve with the one end opening for sliding onto the wood block.

The handle coupling may be of various constructions. For example, a simple handle coupling may include a threaded opening in the top wall of the wooden block. The handle has a threaded end which passes through the opening in the sleeve and into the threaded opening. Other forms such as a swivel coupling including a rod member secured to the top wall and projecting upwardly for receiving of a clip-on secured to the end of a handle. In this instance, the sleeve will be formed with an appropriate slit or opening to expose the coupling rod, again secured to the top side of the wooden block.

In a further aspect of this invention, the bottom wall member may be formed of a sheepskin or a fur member resembling a sheepskin. The fur member must include an outer dense but soft fabric pile of thin, hair-like fiber members such as the hair of sheep, and having a length on the order of one-half inch or more, and with such soft fiber members secured to a fabric backing such as a chenille. Such a bottom wall will not only closely resemble a sheepskin bottom wall but be operative and functioning in substantially the same manner as sheepskin for floor treatment.

Further, applicant has found that a separate top wall or member may be constructed of a relatively thin fabric-like member. It is preferably formed with some lateral support to be used, and contribute to locating the sleeve in firm engagement to the rigid block member. Again, the block member would have a substantial thickness generally at least on the order of a half inch or more as well as a substantial length and width. The top wall of the block member would include a threaded hole or opening to receive a handle. The lower end of the handle would of course have a threaded member for threading into the threaded opening of the rigid block. The handle would also include a portion adjacent such threaded portion to form a locating connection to the threaded opening in the top wall of the fabric. The combination of the top wall with a contributing lateral support characteristic and the interengagement of the handle serve to firmly secure the sleeve to the close fitting rigid block. This system produces a relatively low cost floor treating device with an actual sheepskin bottom wall or the described fur member resembling a sheepskin.

The sleeve construction eliminates the multiple part head and provides a cost effective floor treating device, with ease of assembly and cover replacement. This provides a truly cost effective unit because of the very minimal material costs in not only the use of a single block support, but the use of the least expensive sheepskin in forming of a sleeve.

BRIEF DESCRIPTION OF THE SEVERAL VIEWS OF THE DRAWINGS

The drawings illustrate the best mode presently contemplated of carrying out the invention.

In the drawings:

FIG. 1 is a front elevational view of a treating device of one embodiment of the present invention;

FIG. 2 is a top view of the embodiment shown in FIG. 1;

FIG. 3 is an end elevational view of the embodiment shown in FIG. 1;

FIG. 4 is an opposite end view of the embodiment shown in FIG. 1;

FIG. 5 is a view illustrating the construction of a sleeve shown in FIG. 6—6 of FIG. 5;

FIG. 6 is a vertical section taken generally on line 6—6 of FIG. 5;

FIG. 7 is an end view of the sleeve shown in FIGS. 5 and 6;

DETAILED DESCRIPTION OF THE ILLUSTRATED EMBODIMENT

Figure 8:
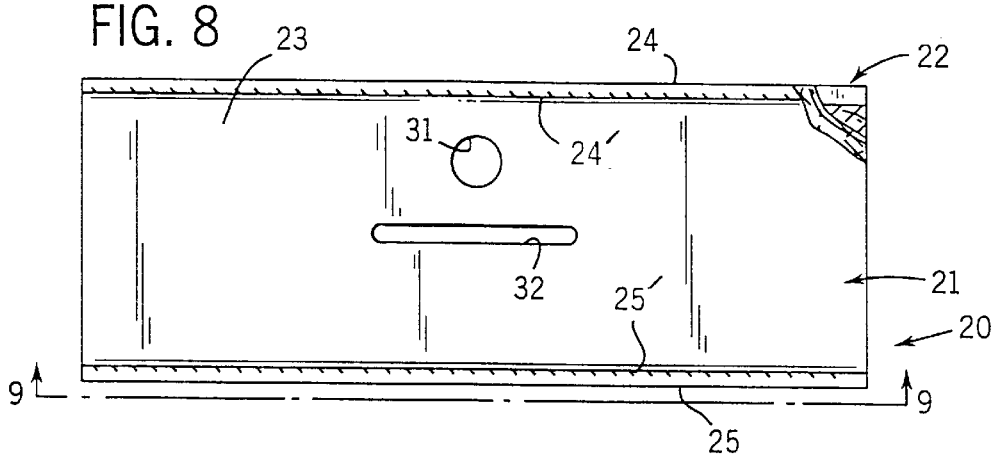
FIG. 8 is a view similar to FIG. 5 illustrating an alternative construction of a sleeve.

Referring to the drawings and particularly to FIGS. 1–4 present invention is illustrated. Referring particularly to FIGS. 1 and 2, the floor treating device 1 as illustrated includes a substantially rectangular head unit 2. A handle 3 extends outwardly from the head unit 2 at an angle for convenient manual manipulation of the floor treating device. The head unit 2 includes an inner single piece head shown as a block 4. The top wall 5 of the head block 4 includes an angled threaded opening 6. The handle 3 has a threaded end 7 which threads into the opening 6 to interconnect the two in accordance with conventional interconnection of known devices. In accordance with the teaching of the present invention, an outer sheepskin sleeve 8 is telescoped over the head block 4 with the nap 9 exposed for engaging and treating the exposed floor and the skin 10 abutting the block 4. The sleeve 8 includes an appropriate opening 11 through which the handle 3 projects into the threaded opening 6. The sleeve 8 fits snugly about the block 4 which with the handle coupling to the sleeve maintains the sleeve position during the treatment of the floor, such as cleaning or polishing thereof. 4 is an opposite end view of the embodiment 5 is a view illustrating the construction of a FIGS. 1–4; 6 is a vertical section More particularly, the one preferred structure of the outer sleeve 8 is illustrated in FIGS. 1–4. The sheepskin sleeve is a tanned hide with the nap exposed and cut to an even outer surface. In particular, the sleeve 8 is shown formed from a single piece of sheepskin and having one closed end 12 and an opposite open end 13 for assembly to the head block 4. In addition, the one-piece sleeve 8 includes a longitudinal seam 14 extended inwardly across the back of the block 4 with the an uninterrupted nap 9 of the sheepskin sleeve 8 engaging the floor 14*a*.

The sleeve of FIGS. 1–4 is thus readily formed from a single sheet or blank 15 of sheepskin, such as illustrated in FIGS. 5–7. Depending upon the size of the sleeve, the sheepskin blank 15 may be formed of any suitable material including scrap material. For larger sized treating devices, the sheepskin blanks may be formed from a larger tanned skin, rather than scrap sheepskin. The sheepskin blank 15 is shown in FIG. 5 with half the blank shown in phantom at 15*a*. The blank 15 is folded onto the nap side 16 (FIG. 6) with the two sets of end edges 17 and 18 and the longitudinal edges 19 aligned, as shown in FIGS. 5 and 6. The aligned edges are then joined to each other along the longitudinal edges 19 and one set of end edges 18 in any suitable manner. Conventional sewing of the edges of the blank 15 just inwardly of the outermost end of the edges has been used in fabrication to form the longitudinal seam 14 and an end seam 18*a*. After sewing, the formed tubular unit of FIGS. 5 and 6 is turned inside out to expose the nap and form the tubular sleeve 8 of FIGS. 1–4, as shown in FIG. 7. The opening 11 in the blank 15 is preferably formed prior to the folding and sewing of the blank edges 18 and 19. As illustrated in FIGS. 1–4, the opening 11 is formed near the one longitudinal edge 19 of the folded blank 15 and thereby located adjacent the longitudinal seam 14 such that in the final assembly, the seam 14 is located on the back surface of the block 4 as shown in FIGS. 2 and 3 to ensure a smooth, continuous floor engaging undersurface of the sleeve.

The illustrated floor treating device with the sheepskin sleeve 8 provides cost effective sheepskin floor treating device. Single piece head, and particularly the illustrated block 4 is simply formed of wood or other material to receive the handle 3, with the handle serving to locate and hold the sleeve 8 in position. The sleeve is also preferably formed with the relatively snug fit of the sleeve onto the block 4 to further contribute to the fixing of the sleeve in place. In addition, the inner longitudinal seam 14 engages the block 4 to further stabilize the sleeve location onto the block during the use.

The illustrated construction provides minimum number of parts, each of which is relatively inexpensive and contributes to a favorable fabrication cost factor. Further, the handle structure and sleeve opening not only provides a cost effective construction, but provides for a rapid and efficient assembly and disassembly of the sleeve.

Figure 9:
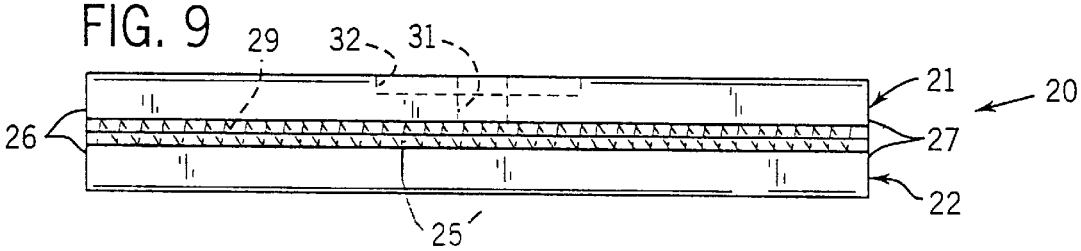
FIG. 9 is a side view of FIG. 8, taken generally on line 9—9 of FIG. 8.

The sleeve as previously discussed, can be formed of interconnected strap material with many different sizes of the head structure. For example, FIGS. 8 and 9 disclose construction of a sleeve 20 from scrap sheepskin pieces or blanks 21 and 22. The pieces are assembled with the nap 23 of the pieces in exposed relation and the longitudinal edges 24 and 25 and side or end edges 26 and 27 in alignment. Both longitudinal edges 24 and 25 are sewn or otherwise securely interconnected to each other to form seams 24' and 25', respectively. One aligned end edge 26 or 27, may also be sewn or otherwise secured to each other and thereby form a tubular sleeve 28 telescoped over a head, shown as block 29, as shown in FIG. 10, of a floor treating device 30.

The one skin blank, shown as 21, is formed with an appropriately located opening 31 and is also shown with an elongated slit 32 extending longitudinally of the device to ensure the location of the longitudinal seams 24' and 25' defined by the sewn edges 24 and 25 along the sides of the sleeve 20 such that on assembly to the block 29, the bottom surface is a smooth, complete, and uninterrupted nap surface. If scrap skins of different widths are used, the opening 31 and slit 32 are placed in one skin to insure spacing of the seams 24' and 25' from the bottom surface.

As previously noted, the interconnection of the handle to the head or block-like member may be of any suitable construction. For example, shown in FIG. 10, a known swivel connector or coupler unit 33 is secured to the upper wall of the block 29. The coupler unit 33 is known a known mop connecting device and includes a U-shaped coupler member 34 with L-shaped legs 35, as shown in FIGS. 10–12. Clamping elements 36 such as simple metal straps are secured as by suitable screws to the block 29 overlying the offset legs 35 and allowing pivoting of the coupler member 34, as shown in FIGS. 11 and 12. The raised cross rod 37 provides for simple interconnection of a handle having a known clip unit 39 on the bottom attachment end. The sleeve 28 for use with the swivel connector or coupler is provided with the slit 32 in the top side of the sleeve through which the rod 37 projects for interconnection to the handle 38. Thus, as in the first embodiment, the sleeve 28, which is slidably fitted over the block, is simultaneously further stabilized through the interconnection of the coupling to the sleeve.

Figure 10:
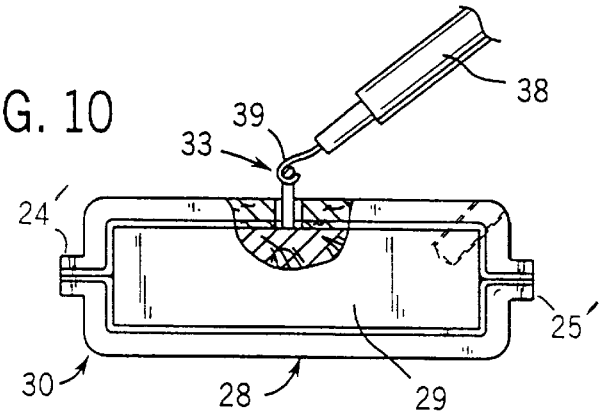
FIG. 10 is an end view of floor treating illustrating a further embodiment of the present invention.
Figure 11:
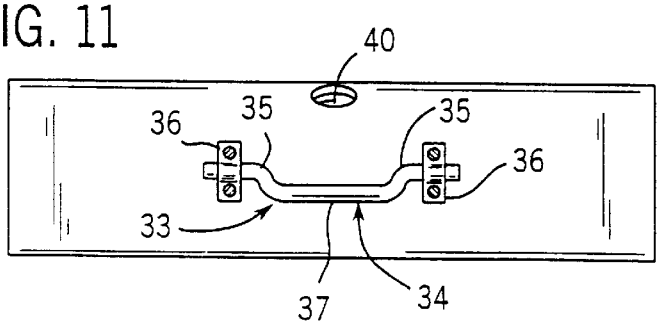
FIG. 11 is a top view of head shown in FIG. 10.
Figure 12:
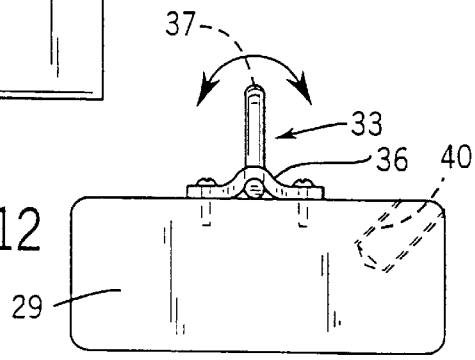
FIG. 12 is an end view of the head shown in FIG. 11.

As illustrated in FIGS. 10–12, said head 29, shown as a block of wood, can be readily formed for receiving either of the couplings 33 (FIGS. 11 and 12 illustrate the head without the sleeve for clearly showing the handle couplers). The threaded opening 40 is offset from the center of the wooden block and adjacent the trailing side of the device. The swivel rod unit 33 is secured generally to the center of the wooden block. The head 29 would thus permit coupling of the sleeve 28 with either handle 38 or a handle 3. Although shown with the head 29 and sleeve 28 with the dual coupling construction, individual related heads and sleeves for each of the coupling systems may, of course, be produced.

As previously noted, the coupling may be as illustrated or of any other suitable releasable handle connection to permit the convenient assembly and replacement of the tubular sleeve. The coupling preferably is constructed to provide a minimum number of different parts and preferably for attachment 35 to the one piece block-like member which can be readily constructed to receive any of the desired handle constructions directly or through the simple location of the handle coupling to the block-like member. 8 insert.

Figure 13:
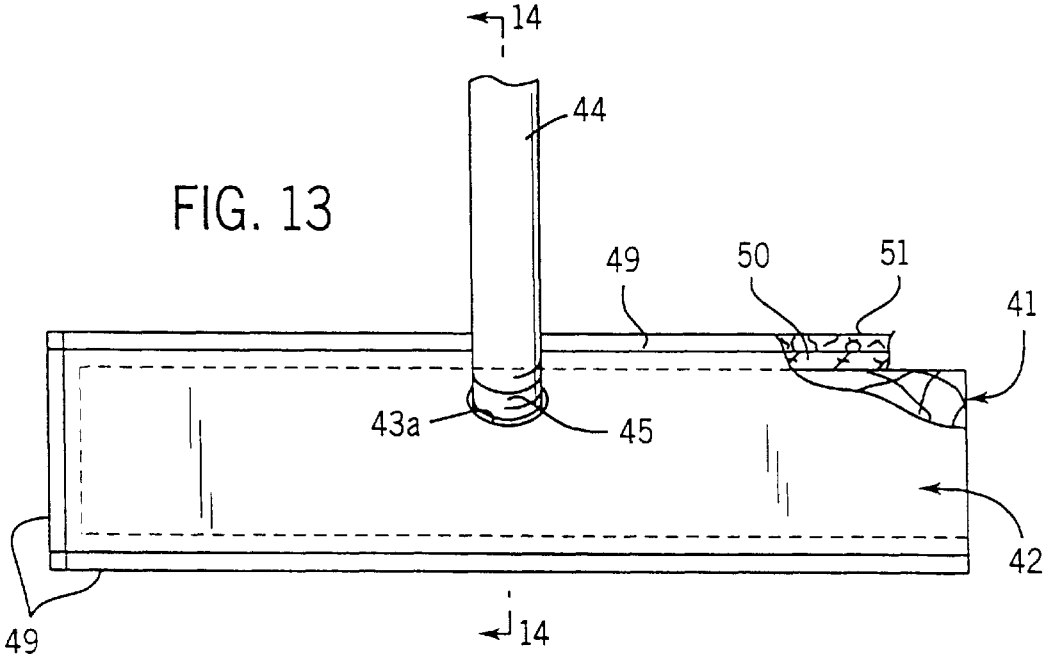
FIG. 13 is a view of a modified construction in accordance with the present invention.
Figure 14:
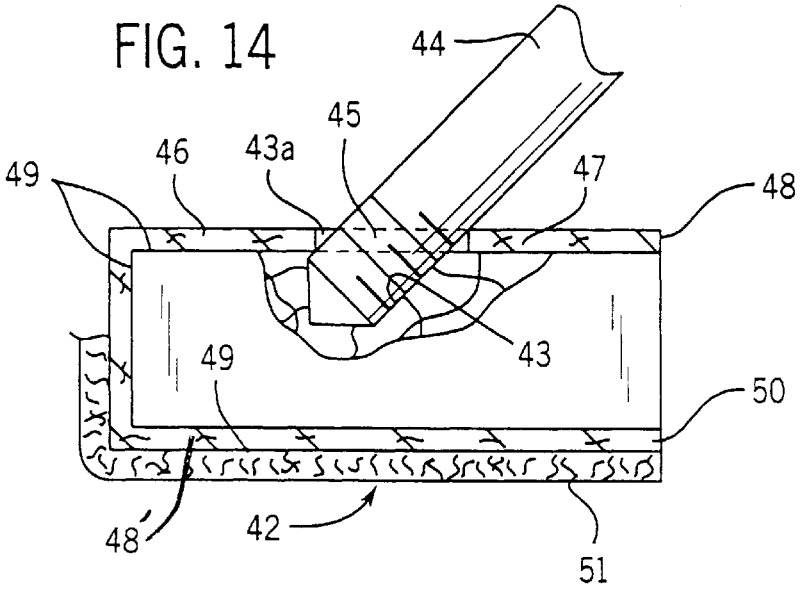
FIG. 14 is a vertical section through the FIG. 13, taken generally on line 14–14 of FIG. 13.
Figure 15:
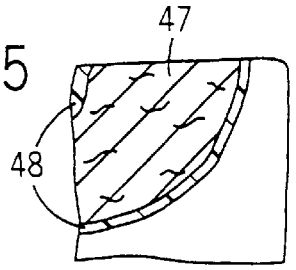
FIG. 15 is a diagrammatic illustration of the construction of the top wall member.

Referring particularly to FIGS. 13–15, a further embodiment is illustrated. In the embodiment of FIGS. 13–15, a rigid block member 41 which is formed of wood or other material supports a removable cover or sleeve 42. The rigid block member as in prior illustrations includes a threaded opening 43 to receive a handle 44 which may be formed of wood or other material. The lower end of the handle 44 has a threaded portion 45 with a thread corresponding to that of the threaded opening 43 for threading into the block member 41 to provide a rigid and firm attachment therebetween. The top wall or member of the sleeve 46 has opening **43*a* aligned with the threaded opening 43. The sleeve opening 43*a* is substantially the same size and configuration as the threaded opening and the adjacent handle portion 45. The sleeve opening 43*a* may substantially engage the peripheral portion of the handle at the threaded connection. Thus, the handle 44 immediately adjacent to the threaded portion has substantially the same configuration as the threaded opening 43 and the opening 43*a*** and provides a structural element for engagement with the sleeve opening.

In this embodiment, the top wall or member 46 of the sleeve 42 is formed of a thin sheet member, but which has a significant lateral strength in the plane of the member. For example, as shown in FIG. 13, a generally loose woven fabric 47 embedded within a thin plastic layer or body 48 has been found to provide a firm support to the sleeve as a result of the adjacent portion of the handle.

As in the prior embodiments, the sleeve is generally shown as a two-piece member having the top wall or member 46 and bottom wall or member 48' secured over the two longitudinal edges and one end edge as at 49, as shown in FIG. 13. The bottom wall member can of course be a sheepskin such as previously disclosed with the skin backing with an actual sheep or lamp outer pile.

Alternatively, the inventor has found that a far fabric member resembling and/or essentially duplicating the characteristic of a sheepskin can also be used satisfactorily. Thus, the bottom wall may include a fabric base 50 with a close woven piling 51 woven therein. The piling consists of thin hair sized fibers such as the hair of sheep, providing soft and dense pile cover on bases. The piling 51 projects outwardly a significant distance and particularly on the order of a half inch or more. The bottom wall in particular may be formed in the form of well known chenille member which includes a fabric base with a loop structure woven therein and defining a relatively deep and thick outer pile of soft fibers which will function in the same manner as the wool pile of sheep or lamp skin. The result is a fabric fur essentially that of an actual sheepskin unit as previously discussed.

As noted above, bottom wall member 48' and the top wall member 46 are formed of a rectangular configuration and sewn or otherwise interconnected as at 49, and are shown connected on the two longitudinal edges and a one transverse end or edge to form tubular sleeve 42 which fits closely over the rigid block member.

The combination of the close fit and the interconnected opening provides for reliable and stable interconnection for application of the floor treating device in polishing of the floor.

The embodiments shown in the drawings are thus illustrative of the preferred constructions, which can, of course, be modified if desired in any suitable manner, while maintaining the efficiency and effectiveness of the assembly and cost effectiveness of the device. Clearly, both ends of the tubular sleeve can be opened. Further, where a single piece blank is used, the opening for the handle may be formed in the seam by providing an unsewn portion in the seam and in appropriate longitudinal alignment with the handle opening or other securement system. The significant factor is to maintain the simplicity of the assembly, including a single head adapted to releasably receive a handle and a sleeve encircling the block with appropriate interengagement by the handle and coupling through the handle to the head.

I claim:

1. A floor treating device, comprising an elongated rigid block having a depth of at least one half inch and being an elongated and substantially rectangular block having a top side with a central portion, a tubular sleeve close fitted over the block, said sleeve including a top sleeve member in the form of a sheet establishing lateral strength within the sheet, a bottom sleeve member secured to said top sleeve member to form a tubular sleeve with close fit to the block, said top side of said block having a threaded opening located generally in said central portion, a handle having a threaded end portion adapted to be releasably threaded into said opening, said top sleeve member having an opening overlying said threaded opening and being of substantially the same size as said opening and said threaded end portion, and said handle passing through said opening in said top sleeve member and serving as the sole support maintaining said sleeve in essentially its initial and predetermined orientation on said block for floor treatment movement of the block over the floor.

2. The floor treating device of claim 1 wherein said top sleeve member includes a plastic sheet having a fabric embedded within said plastic sheet to establish said lateral strength and the firm support for the sleeve on the block.

3. The floor treating device of claim 1 wherein said bottom sleeve member is a sheepskin member.

4. The floor treating device of claim 1 wherein said bottom sleeve member includes a fabric base and a soft woven pile of hair sized fibers woven within said fabric base.

5. A floor treating sleeve for releasable placement over a rectangular block of a floor treating device, said block having a top side and a bottom side and having a depth of at least one half inch, said top side having a threaded opening for releasably receiving a handle extending outwardly therefrom and with the handle adjacent said threaded opening having a configuration substantially corresponding to said threaded opening, the improvement wherein said sleeve comprises a tubular sleeve having a top sleeve member and a bottom sleeve member, said top and bottom sleeve members being slightly larger respectively than the configuration of the top side and the bottom side of said block and said top sleeve member and said bottom sleeve member being interconnected to each other on opposed edges to form a tubular member configured to establish a close fit over said block, said top sleeve member being a fabric-like member having a significant lateral strength in the plane of the member, said top sleeve member having a sleeve opening corresponding substantially in size to said threaded opening and configured for alignment with said threaded opening when said top sleeve is fitted to said block with said sleeve opening engaged by said handle, said bottom sleeve member having a support base abutting said block and an outer thick loose pile of a depth of at least one-half inch secured to said support base.

6. The sleeve of claim 5 wherein said top sleeve member is formed of a plastic sheet with a fabric embedded within said plastic sheet to establish said lateral strength.

7. The sleeve of claim 5 wherein said bottom sleeve member is a sheepskin member.

8. The sleeve of claim 5 wherein said support base is a fabric base and said thick loose pile is a woven pile.

* * * * *